US007082746B2

(12) United States Patent
Brandl et al.

(10) Patent No.: US 7,082,746 B2
(45) Date of Patent: Aug. 1, 2006

(54) PROCESS AND DEVICE FOR THE PIECING OF A YARN IN AN OPEN-END SPINNING DEVICE

(75) Inventors: Sebastian Brandl, Böhmfeld (DE); Frank Baier, Geisenfeld (DE); Marc Schnell, Rehau (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 44 days.

(21) Appl. No.: 10/870,713

(22) Filed: Jun. 17, 2004

(65) Prior Publication Data

US 2005/0044841 A1 Mar. 3, 2005

(30) Foreign Application Priority Data

Jun. 18, 2003 (DE) ..... 103 27 370

(51) Int. Cl.
*D01H 4/48* (2006.01)

(52) U.S. Cl. ..... 57/263; 57/264

(58) Field of Classification Search ..... 57/261–265; 700/139–144

See application file for complete search history.

(56) References Cited

U.S. PATENT DOCUMENTS

| | | | | |
|---|---|---|---|---|
| 3,805,244 | A * | 4/1974 | Tooka | 700/33 |
| 4,821,502 | A | 4/1989 | Bur sek et al. | |
| 5,258,916 | A | 11/1993 | Langheinrich et al. | |
| 5,381,340 | A * | 1/1995 | Ueda et al. | 700/130 |
| 5,557,916 | A | 9/1996 | Messmer et al. | |
| 6,035,622 | A * | 3/2000 | Fox et al. | 57/263 |
| 6,339,921 | B1 * | 1/2002 | Lassmann et al. | 57/264 |
| 6,574,526 | B1 | 6/2003 | Gaukler et al. | |
| 6,761,022 | B1 * | 7/2004 | Zipperer | 57/263 |

* cited by examiner

*Primary Examiner*—Shaun R Hurley
(74) *Attorney, Agent, or Firm*—Dority & Manning

(57) ABSTRACT

For the piecing of a yarn in an spinning device, various computation formulas are stored in a control device into which calculated values as well as special data converted into numerical values relating in particular to the fiber material, the yarn and the spinning element are first entered to compute and select settings for operations relevant to the piecing process. A feeding device feeding a fiber sliver to the spinning device is first brought to a high pre-feeding speed by means of such pre-programmed values and converted data. From this pre-feeding speed, the feeding speed is greatly decelerated in steps to its piecing feeding speed in coordination with the release of the yarn to be fed back into the spinning element.

24 Claims, 3 Drawing Sheets

PROCESS AND DEVICE FOR THE PIECING OF A YARN IN AN OPEN-END SPINNING DEVICE

BACKGROUND OF THE INVENTION

The present invention relates to a process for the piecing of a yarn in an open-end spinning machine equipped with a spinning element in which several work phases are carried out as a function of previously selected settings as well as to a device to carry out this process.

For the piecing of a yarn as well as during production, a great number of settings that vary as a function of a great number of factors are required. At the same time, it must be considered above all that the piecing phase is especially critical with respect to the risk of yarn breakage. When spinning conditions change, e.g., when there are changes in fiber material, yarn thickness, rotor size, draw-off speed, etc., the operator is therefore forced in practice to make several attempts in order to find the correct setting for the activities of the aggregates that influence the piecing process. Such attempts are time consuming and therefore expensive.

SUMMARY OF THE INVENTION

It is, therefore, a principal object of the present invention to create a process and a device for making it possible to select the settings of these aggregates having an influence on the piecing process easily and reliably as well as with simple means. Additional objects and advantages of the invention will be set forth in part in the following description or may be obvious from the description; or may be learned through practice of the invention.

The principal object is attained by the invention through different computation formulas to be provided to compute the settings of work phases relevant to the piecing process. Previously calculated values to be incorporated into these computation formulas are preprogrammed. Also, special data relating in particular to the fiber material, the yarn as well as the spinning element are programmed for currently prevailing spinning computed in addition to the settings for the piecing process conditions and are converted into numerical values to be incorporated into the computation formulas. Further, the settings for work phases relevant to the piecing process are computed by means of the provided computation formulas by linking them to the preprogrammed as well as the converted values. In this manner, and in spite of the complexity of the processes, the required settings of all the aggregates participating in the piecing process are realized in an optimal manner. The parameters that are necessary for this are in part already pre-programmed and are selected and incorporated into the computation formulas by entering certain data regarding fiber material, yarn characteristics, drafting, etc.

By further developing the process so that different preprogrammed values are assigned to the different materials to be spun, and, based on the special data pertaining to the fiber material, the preprogrammed values assigned to this fiber material are incorporated into the computation formulas, the fact that different materials also require different settings can be taken into account.

Since the piecing process also depends on operations that are carried out during the stopping phase and/or during the stoppage time of such an open-end spinning device, settings for operations influencing the piecing process during the stopping phase and/or the stoppage of the open-end spinning device can also be computed in particular based on the preprogrammed values and on the entered data.

In a simple embodiment of the process, the computed settings are displayed and are selected by an operator in accordance with these computed indications. In a preferred embodiment of the process, the settings are translated into suitable control of the operations participating in these work phases, and are realized also without intervention by the operator. Since the pre-programmed values represent a kind of key values, these pre-programmed values can be write-protected in another advantageous embodiment of the process of the invention, so that only the person authorized to do so can change such values upon entering a code.

It is advantageous to implement the process of the invention, whereby the entering of data that are significant for the piecing process is facilitated for an operator. The values and data relating to the machine elements and having an effect on the piecing process can be stored and called up by entering a model designation to be incorporated into the corresponding computation formulas. The values assigned to a model designation can, in case of a spinning rotor, include in particular its form and its diameter, but also its maximum and possibly also its minimum rotational speed as well as its surface characteristics.

Since the utilization of the so-called fiber flow during the piecing process depends essentially on the state of the forward end of the fiber sliver, the so-called fiber tuft, a retraction of the fiber tuft from the opener device's range of action and resumed presentation to the opener device during the piecing process can advantageously be ensured during a stopping process of an open-end spinning device. Preprogrammed values and the data settings are entered for the point in time and the distance of retraction of the fiber tuft from the action range of the fiber sliver opener device during the stopping process. Further, settings for the point in time and the releasing speed for the resumed feeding of the previously retracted fiber tuft to the fiber opener device during the piecing process are computed for the preparation of the fiber tuft.

In order to be able to avoid unevenness of the yarn to a great extent during piecing, the fiber feeding speed can be controlled. A feeding device feeding a fiber sliver to an open-end spinning device is first brought to a high pre-feeding speed which is then greatly reduced in steps to a piecing speed in coordination with the release of the yarn to be fed back into the spinning element. The feeding device has predetermined a speed ratio relative to the spinning element driven at a reduced piecing speed, whereby the feeding device is driven at a substantially constant speed for a pre-calculated period of time after each speed reduction step. This type of control makes it simply possible to optimize the piecing process and the resulting piecing joint produced by it.

It has further been shown that in particular through the design of the previously described process, thick and thin spots that otherwise usually appear during piecing can be effectively avoided by the feeding device going through at least two speed steps, one after the other, in which the feeding speed is kept constant or within a narrowly described speed range during the reduction of its speed from the pre-feeding speed to the piecing speed. The timing and magnitudes of the feeding device and the speed steps can be determined in such manner that a thick spot in the drawn-off yarn in the overlapping area of the back-fed yarn and the fiber ring produced by the fiber feeding before start of the yarn draw-off and/or within the zone of incorporation of the residue of this fiber ring, and/or a thin spot following this overlapping area and/or at this incorporation area is avoided. Further, the speed differences between the speeds and/or speed steps of the feeding device can be determined so that they decrease from the higher pre-feeding speed in the direction of the piecing speed.

Computation formulas can also be provided for the computation of a piecing preparation of the yarn end to be fed back into the spinning rotor and for the computation of the back-feeding into the spinning rotor.

In another advantageous embodiment of the process according to the invention, the twists required for a reliable incorporation of the fiber ring formed by pre-feeding can be calculated.

Depending on the fiber material, the fibers have varying behaviors with respect to the conveying air stream by means of which they are to be removed from the spinning rotor while it is being cleaned. The type, frequency and times of a one-time or multiple cleaning of the spinning rotors during its stoppage and/or running up to a reduced piecing speed can be calculated based on the preprogrammed values and the entered data. The optimal manner of carrying out rotor cleaning can therefore be calculated.

To carry out the process of the invention, a device for piecing of a yarn in an open-end spinning device is used. A control device is provided with a memory in which a plurality of computing formulas for the computation of operations that are relevant for the piecing process as well as previously determined values to be incorporated into the stored computing formulas can be stored. An input device is also provided to enter in particular data relating to the fiber material, the yarn to be produced as well as the spinning element. The data can be converted by the control device into additional numerical values that can be incorporated into the computing formulas, whereby settings for the control of a plurality of aggregates participating in the piecing process can be computed by means of the computing formulas. The memory contains computation formulas as well as values to be incorporated into these computation formulas, whereby their correct selection is determined by the data entered by an operator and relating to the current spinning conditions.

For this purpose, the device can be designed so that settings can also be calculated for work phases that are carried out during the stopping phase and/or during the stoppage of the open-end spinning device and have an influence on the subsequent piecing process. Accordingly, the aggregates are advantageously connected to the control device for that purpose.

An inventive step by step reduction of the pre-feed by a device for the piecing of a yarn in an open-end spinning device can considerably improve the aspect of the piecing joint produced by the piecing process and can especially avoid thick and thin spots in critical longitudinal segments of the piecing joint.

The process according to the invention as well as the device according to the invention make it possible to optimize in a simple manner the settings that are relevant for the operations relating directly or indirectly to a piecing process. Such a process and such a device can also be applied without problems by retrofitting open-end spinning machines already operating in production, since as a rule only minimal changes are required on the control device, e.g., replacing a data support with a data support of greater capacity, as well as utilizing new programs. The process as well as the device according to the invention facilitate the operator's tasks considerably, since he need not conduct tests to determine the settings to be selected but can simply enter into the control device information on the fiber material to be spun, the desired character of the yarn to be spun as well as the machine elements that may influence interruptions in spinning.

If the speed of the feeding device is reduced according to the invention by steps from a relatively high pre-feeding speed to the piecing speed, thick and thin spots in the piecing area of the yarn can be avoided in a targeted manner by means of control adapted to the yarn draw-off. For this too, minimal changes on the control device as well as the utilization of new programs suffice.

Examples of embodiments of the inventions are explained below through drawings.

DETAILED DESCRIPTION

Reference will now be made in detail to the presently preferred embodiments of the invention; one or more examples of which are shown in the figures. Each example is provided to explain the invention, and not as in limitation of the invention. In part, features illustrated or described as part of one embodiment can be used with another embodiment to yield still a further embodiment. It is intended that the present invention cover such modifications and variations.

Figure 1:
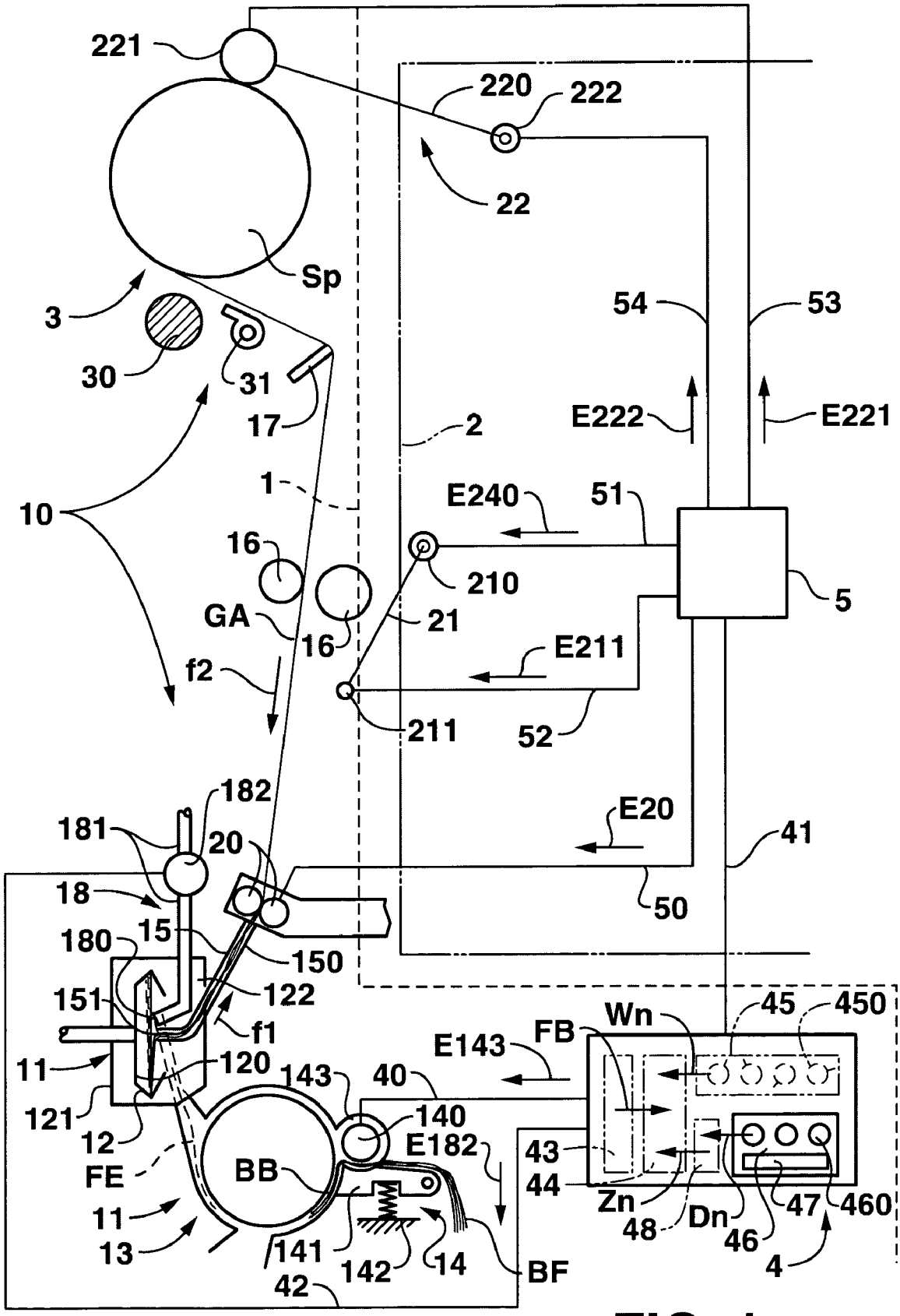
FIG. 1 shows a schematic lateral view of a work station of an open-end spinning machine according to the invention as well as maintenance apparatus interacting with it.

First to be described with the help of FIG. 1 is a device used to carry out the process according to the invention, whereby only those elements and aggregates are shown and described which are necessary to understand the process.

On the left side of FIG. 1, a broken line indicates an open-end spinning machine 1 having as a rule a plurality of identically designed work stations 10, each with an open-end spinning device 11 as well as with a spooling device 3. To service these work stations 10 located next to each other, a maintenance apparatus 2 is provided and is indicated in FIG. 1 by a dot-dash line on the right side.

With suitable adaptation the process according to the invention can in principle be used on the widest variety of open-end spinning machines 1. Each workstation 10 of the machine may be provided, e.g., with an electrostatically or pneumatically operating spinning element or, instead of with one single spinning element, with two identical or non-identical spinning elements (not shown).

In the embodiment shown in FIG. 1, a spinning element in the form of a spinning rotor 12 is provided for each spinning device 11 and is supplied continuously during the spinning process with single fibers $F_E$ that are combed out by an opener device 13 from a fiber sliver $B_F$ that is fed to it by means of a feeding device 14. This feeding device 14 consists of a driven feed roller 140 and of a feed trough 141 that is pushed in the direction of the feed roller 140 by means of a compression spring 142.

The spinning rotor 12, which can be driven in the usual manner, is located in a housing 121 and is covered by a rotor cover 122 that can be opened. The rotor cover 27 is provided among other things with a yarn draw-off channel 15 which pulls a yarn $G_A$ during normal spinning in the direction of arrow $f_1$ in yarn draw-off direction and during back-feeding into the spinning rotor 12 in the direction of arrow $f_2$ in back-feeding direction. Upon leaving the yarn draw-off channel 15, the spun yarn $G_A$ reaches a pair of draw-off rollers 16 and from there, via a yarn tension equalization hoop 17, the spooling device 3. The spooling device 3 is provided with a winding roller 30 to drive a bobbin $S_P$ formed by winding up the spun yarn $G_A$ as well as a traversing guide 31 for the traversing placement of the yarn $G_A$ to be wound up.

In the embodiment shown in FIG. 1, a stationary rotor cleaning device 18 with a compressed-air nozzle 180 supported by the rotor cover 122 and directed towards the bottom 120 of the spinning rotor 12 is provided for each work station 10 and forms the end of a compressed-air conduit 181 with a control valve 182. The control valve 182 is connected via a control conduit 42 to the control device 4.

The maintenance apparatus 2 capable of traveling alongside the open-end spinning machine 1 is equipped with a plurality of elements and aggregates by means of which it carries out a piecing process at the affected work station 10 following a wanted or unwanted interruption of the spinning process, e.g., due to a yarn breakage or other circumstances. As a rule, the maintenance apparatus 2 is designed so that it is also able to perform additional tasks, e.g., a bobbin replacement and/or also a cleaning of the spinning rotor 12 or of a spinning element of different design. For this purpose, the maintenance apparatus 2 is provided with a control device 5, which is connected for control to the control device 4 on the machine and also to the controlled aggregates of the maintenance apparatus 2. Thus, the control device 5 is connected by means of a control conduit 50 to an auxiliary pair of rollers 20 that can be brought in the usual manner from a rest position that is not shown inside the maintenance apparatus 2 into a work position in which it is located directly in front of the outlet opening 150 of the yarn draw-off channel 15. This auxiliary pair of rollers 20 can be driven selectively so that the yarn $G_A$ located in the nip of this auxiliary pair of rollers 20 can be either fed back in the direction of arrow $f_2$ into a readiness position within the yarn draw-off channel 15 or can be drawn off from the spinning rotor 12 in the direction of arrow $f_1$, depending on the work phase.

The maintenance apparatus 2 is provided with a yarn reserve hoop 21 which serves to constitute a piecing yarn reserve and can be moved by means of a swivel drive 210 from a rest position that is not shown within the contour of the maintenance apparatus 2 into a working position determined as a function of various factors. For this purpose, the swivel drive 210 is connected by means of a control conduit 51 to the control device 5. At its free end the yarn reserve hoop 21 is provided with a throw-off device 211, e.g., in the form of a retractable bolt (not shown) or a driven winding bobbin (also not shown) through which the yarn $G_A$ is released in a controlled manner for piecing back-feeding into the spinning rotor 12. For this purpose, the throw-off device 211 is connected by means of a control conduit 52 to the control device 5 for control.

The maintenance apparatus 2 is furthermore provided with an auxiliary drive 22 that can be assigned to the bobbin Sp and is equipped with a swivel lever 220 with an auxiliary drive roller 221 at its free end which can be driven in the unwinding direction (see arrow $f_2$) as well as in winding direction (see arrow $f_1$) and is connected for that purpose via a control conduit 53 to the control device 5. The presentation of the auxiliary drive roller 221 to the bobbin $S_P$ which can be lifted off the winding roller 30 as well as its subsequent lifting from the bobbin $S_P$ take place by means of a swivel drive 222 assigned to the swivel lever 220 and connected via a control conduit 54 to the control device 5.

Following the description of the most important elements and aggregates of the work station 10 as well as of the maintenance apparatus 2, the construction of the control device 4 shall now be described in further detail. The control device 4 is provided with a memory 43 in which the computation formulas $F_B$ relevant for a piecing process are stored. In addition, the control device 4 is provided with a computer 44 which calculates the settings $E_n$ by means of the computation formulas $F_B$ for the working phases that relate to piecing.

The control device 4 is provided in addition with two input devices 45 and 46, each with input elements 450 or 460. The input device 45 is covered in a suitable manner and is thus not accessible to machine operators, and for this reason this input device 45 is indicated by a broken line as is the memory 43 and also the computer 44, contrary to the input device 46 which is indicated by a continuous line. In the embodiment shown the control device 4 is also provided with a display 47 to display settings $E_n$ that were selected.

Using the input device 45, an authorized person is able to program a great amount of data, hereinafter designated as values $W_n$. These values $W_n$ were first determined in a suitable manner, e.g., empirically, and as a rule no longer need to be changed, whatever the applicable current spinning conditions may be. Nevertheless, it may prove to be advantageous or even necessary to change the values $W_n$ again or to provide additional values Wn to be incorporated into the computation formulas $F_B$ already stored in the memory 43.

The input device 46, which contrary to the input device 45 is easily accessible, is used by the machine operator to enter current information designated as data $D_n$. Such data $D_n$ relate to current spinning conditions, in particular to the fiber material (material, staple length of the fibers $F_E$, thickness of the fiber sliver $B_F$ supplied to the feeding device 14, etc.) and to the yarn $G_A$ to be spun (yarn thickness, yarn structure and surface, torsion, etc.), and also to the configuration of the spinning element (in case of a design of spinning rotor 12 for example, its inside diameter and its permissible rotational speeds) Also, if necessary, such data $D_n$ can relate to the design of additional elements, e.g., to a torsion element (not shown) that can be incorporated into the yarn draw-off channel 15, or a draw-off nozzle 151 located in the end of the yarn draw-off channel 15 towards the spinning rotor 12. As a result, the data $D_n$ to be entered by the operator cannot always be entered in the form of numerical values. For this reason the control device 4 is also provided with a converter 48 by means of which the data $D_n$ entered by the operator are converted into numerical values, hereinafter numerical values $Z_n$, which are incorporated into the appropriate computation formulas $F_B$ stored in the memory 43.

To control all the known work phases during the piecing process, several settings $E_n$ are required for start of action, duration of action and intensity of action (e.g., speed) and these are to be computed by means of suitable computation formulas $F_B$ in the computer 44. In this process, one or several of the values $W_n$ as well as one or several of the data $D_n$ entered by the operator once they have been converted into numerical values $Z_n$ are as a rule taken into account, so that the settings $E_n$ are always a function $f$ of the preprogrammed values $W_n$ generally applicable to all spinning conditions, and of the numerical values $Z_n$ resulting from the data $D_n$ ($E_n=f(W_n, Z_n)$). Depending on the work phase to be controlled, various kinds as well as various numbers of values $W_n$ and numerical values $Z_n$ are to be incorporated into the different computation formulas $F_B$ and must furthermore be interlinked in various ways since not all preprogrammed values $W_n$ and data $D_n$ entered by machine operators have the same effect on the settings $E_n$ to be selected. It results from this that the preprogrammed values $W_n$ and numerical values $Z_n$ to be incorporated into the computation formulas $F_B$ are of different kinds depending on the setting $E_n$ to be calculated, and have therefore different numerical orders of magnitude.

In FIG. 1, the association of the different settings $E_n$ with certain aggregates and devices within the open-end spinning machine 1 and within the maintenance apparatus 2 are indicated by an arrow with an index indexing the aggregate concerned. Thus, according to FIG. 1, the setting $E_{143}$ of drive 143 of the feeding device 14 and the setting $E_{182}$ of the control valve 182 of the rotor cleaning device 18 are controlled by the control device 4. In analogous manner, the settings $E_{221}$ and $E_{222}$ relate to the auxiliary drive roller 221 and to the swivel drive 222 of the auxiliary drive 22, while the settings $E_{210}$ and $E_{211}$ relate to the swivel drive 210 and the throw-off device 211 of the yarn reserve hoop 21 and the settings $E_{20}$ relate to the auxiliary pair of rollers 20.

By means of the computer 44, additional settings $E_n$ are calculated, e.g., for drafting as well as maximum draw-off speed at which the yarn $G_A$ is to be drawn off from the spinning rotor 12 during the different drawing-off phases $V_{F1}$ and $V_{F2}$ (see FIG. 2) of the drawing-off process as well as subsequently under normal production conditions.

Even if it is not shown, it is obvious that the speed progression of the spinning rotor 12, in particular its piecing speed, can be determined on basis of established computation formulas $F_B$.

It has been shown that different values $W_n$ must be incorporated into the computation formulas $F_B$ depending on the fiber material to be spun. Thus, for example, different values $W_n$ are to be used for cotton than when viscose, polyester, polyacryl or regenerates are being processed. The necessary selection for incorporation into the computation formula $F_B$ is made based on the data $D_n$ entered by the operator.

The process according to the invention as well as the device according to the invention can be modified in many ways within the framework of the present invention, in particular by replacing elements or process steps by equivalents or through other combinations of elements, process steps or equivalents thereof. Thus, the described process may be limited solely to piecing with the work phases if fiber feed, fiber back-feed and fiber draw-off. on the other hand, the process can also be expanded in such manner to include those work phases which take place during the stopping of a spinning station 10 or during its stoppage but have an effect on the subsequent (actual) piecing process. Accordingly, settings $E_n$ of this type are also to be entered into the control device 4 and/or 5 for the computation also of such settings $E_n$.

An embodiment of this is described below through FIG. 3 from which the effects of the settings $E_n$ computed by of means the computation formulas $F_B$ can be seen.

To ensure that the same piecing conditions always prevail independently of the duration of stoppage of a spinning device 11 to be pieced, the fiber tuft $B_B$ is already prepared as the affected work station 10 is being stopped so that it is always available in the same state for piecing and so that the same settings $E_n$ can always be selected for the piecing phases independently of the stoppage time of this work station 10.

Work phase A characterizes the stoppage of a work station 10. Among the stopped aggregates and devices is also the feeding device 14. To begin with, it must be ensured that the fiber tuft $B_B$ is combed out by the opener device 13 for a defined period of time, while the feed roller 140 is stopped. In a second work phase B, it must therefore be ascertained whether the time calculated by a computed setting $E_1$ has been reached. In the affirmative, identified by a "+" sign, the next work phase C follows. If, on the other hand, the prescribed time has not yet been reached, as is indicated in the diagram by a "−" sign, the combing out of the fiber tuft $B_B$ is continued until the time prescribed by the computed setting $E_1$ has finally been reached.

In work phase C, concluding the stoppage phase of workstation 10, the fiber tuft $B_B$ is pulled back over a defined distance and is thereby removed from the action range and the effects of the opener device 13. According to the embodiment shown in FIG. 1, this withdrawal of the fiber tuft $B_B$ is affected by reverse rotation of the feed roller 140. The predetermined time, calculated by a computed setting $E_2$, during which the drive 143 rotates the feed roller 140 in a reverse direction determines in this case the distance over which the fiber tuft $B_B$ is removed from the opener device 13. Here too, the settings $E_2$ is a function f of the preprogrammed values $W_n$ and of the data $D_n$ converted into numerical values Zn such that f ($W_n$, $Z_n$).

If the maintenance apparatus 2 stops at the work station 10 at a later point in time, the control device 4 asks whether a piecing process can now be initiated (work phase D). As long as the maintenance apparatus 2 is still busy with another maintenance task (e.g., a bobbin replacement) this question (minus sign) is repeated. As soon as the maintenance apparatus 2 is ready to carry out a piecing process (plus sign), the control device 4 cleans the spinning rotor 12 (work phase E) during a predetermined period of time.

The manner in which the frequency and the point in time at which, relative to the subsequent piecing process and planned start of running-up of the rotational speed of the spinning rotor 12, rotor cleaning (and if necessary also cleaning of some other spinning-related element, e.g., the draw-off nozzle 151) is to be carried out is calculated by means of the appropriate computation formula $F_B$. Thus, two different types of cleaning $R_1$ and $R_2$ can be applied selectively in the embodiment described with the help of FIG. 3, whereby their special manner of execution is in principle unimportant. To carry out the first cleaning type (cleaning type $R_1$), for example, the rotor cover 122 is removed sufficiently far from the spinning rotor 12 so that a cleaning device (not shown) located on the maintenance apparatus 2 can be presented to the spinning rotor 12 and cleaning can then be carried out in a known manner. Cleaning type $R_2$ could be cleaning by means of the rotor cleaning device 18 on the machine that can be actuated by actuating the control valve 182 so that a flow of compressed air is directed on the bottom 120 of the spinning rotor 12. In a variant of this embodiment, the compressed-air conduit 181 can traverse the rotor cover 122 and can be controlled by a compressed-air conduit located on the maintenance apparatus 2, so that rotor cleaning can take place while the rotor cover is closed.

Following the initiation of rotor cleaning (work phase E), a determination is made during work phase, or operation, F (setting $E_4$) whether the cleaning type $R_1$ is to be used. If this is the case (plus sign), cleaning according to the prescribed cleaning type $R_1$ follows as work phase, or operation, G. Otherwise (minus sign) the other cleaning device (cleaning type $R_2$) is brought into action (work step H). It is possible in this case to modify either of the two types of cleaning, $R_1$ and $R_2$, i.e., by means of different commands given to a cleaning air stream (permanent, intermittent, in regular or irregular alternation of the permanent and the intermittent air stream, etc.) or by means of a mechanical cleaning element. This control is effected on basis of another setting $E_5$ (cleaning type $R_1$) or $E_6$ (cleaning type $R_2$).

The operation G for cleaning type $R_1$, or H for cleaning type $R_2$, is followed by a work phase I or J, respectively, in which the program questions whether the predetermined time according to setting $E_7$ or setting $E_8$ has been reached. In the negative case (minus sign), cleaning according to operation G or H is continued, while, in the affirmative case (plus sign), a joint decision is made with work phase K for both cleaning types $R_1$ and $R_2$ based on an additional setting $E_9$ whether another cleaning process (plus sign) or the piecing process (work phase L) (minus sign) is to be initiated in a more narrow sense. In the first instance, renewed execution of operation E as a new operation $E_a$, as well as the following work phases $F_a$, $G_a$, $I_a$ or $F_a$, $H_a$, $J_a$ are carried out, depending on the cleaning process whereby the cleaning type $R_1$ or cleaning type $R_2$ that is now desired or determined by the setting $E_{4a}$ is now applied, whether or not the cleaning type $R_1$ or $R_2$ was used in the first cleaning operation. The work phases $E_a$ to $J_a$ of the second run are similar to the work phases E to J of the first run, but these work phases $E_a$ to $J_a$ are a function of the settings $E_{3a}$ to $E_{8a}$ calculated for this repetition.

Figure 3:
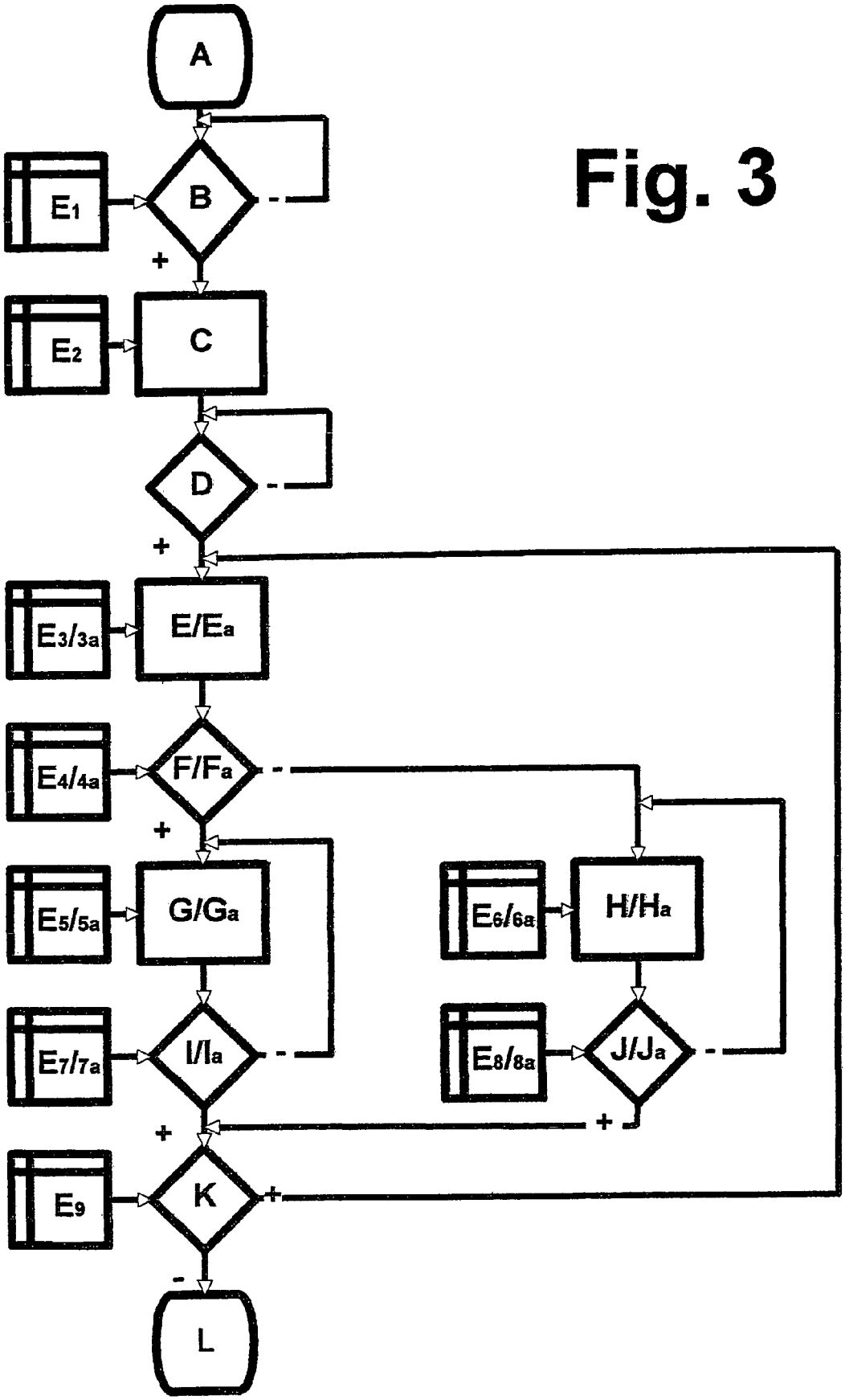
FIG. 3 shows in the form of a flow chart the effects of settings on work phases influencing the piecing process which can however be applied already in the pre-drafting zone of the piecing process.

As was explained above with the help of the flow chart according to FIG. 3, the work phases initiated with work phase L are also controlled in an analogous manner, whereby every time any settings $E_n$ are to be selected, the type and magnitude of these settings $E_n$ are determined by a corresponding computation formula $F_B$. Among these work phases is in particular also the renewed release of the fiber tuft $B_B$ at a point in time determined by a computation formula $F_B$ as well as at a speed calculated by an additional computation formula $F_B$ at which the fiber sliver $B_F$ is again conveyed to the opener device 13 so that the fiber tuft $B_B$ is in a state defined for the piecing process.

Figure 2:
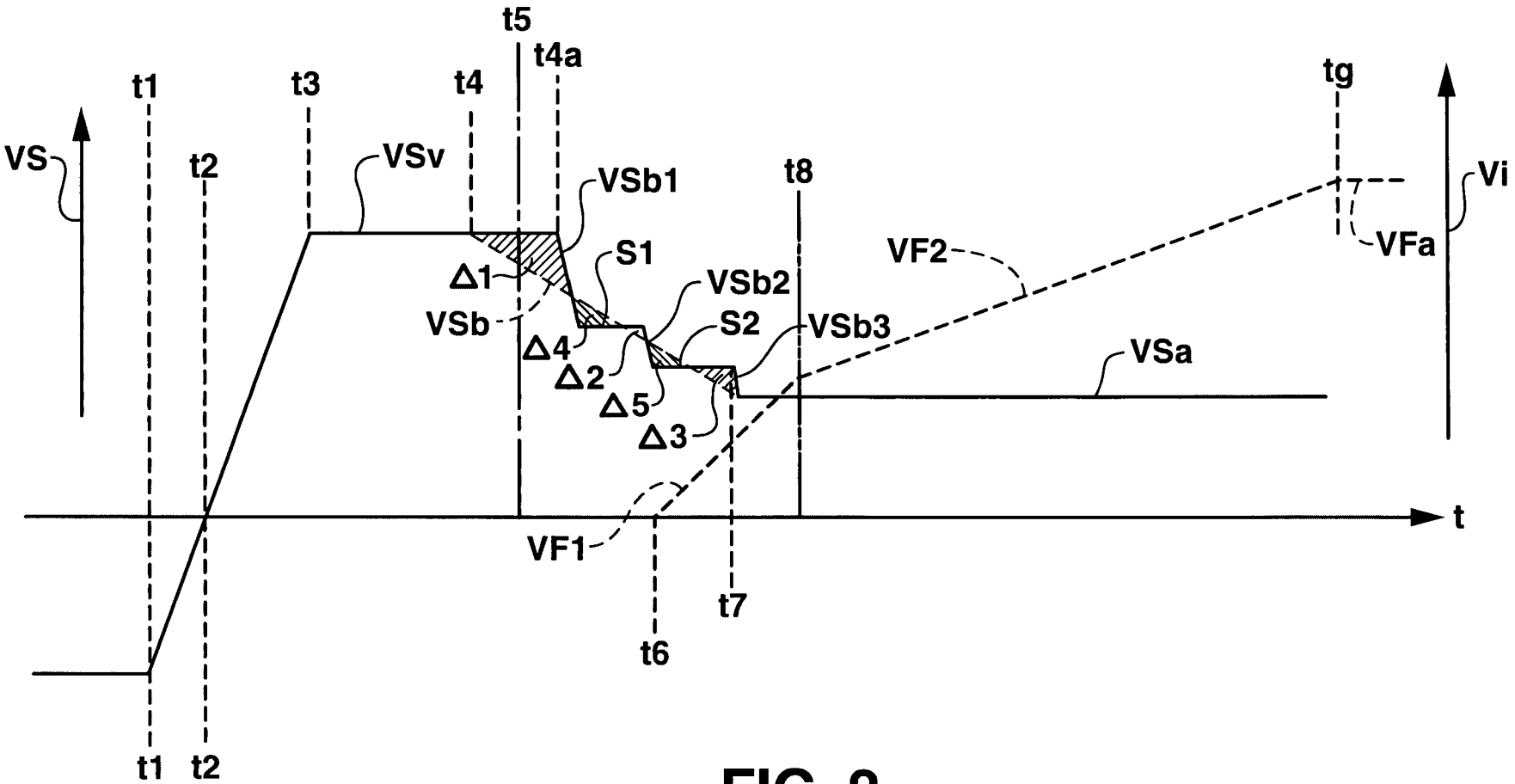
FIG. 2 shows a diagram of the speed progression of fiber feed as well as of fiber draw-off during the piecing process.

The piecing process initiated with the work phase L in the narrower sense is now explained through FIG. 2. In it, the abscissa represents the time axis t while the ordinate represents the speed $V_S$ (on the left side in the figure) of the feed as well as the speed $V_F$ of the yarn draw-off (on the right side in the figure) which are shown at different scales for reasons of visualization, so that the two speeds $V_S$ and $V_F$ can be shown in one and the same system of coordinates in spite of the enormous differences in speed. The curve representing the feeding proceeds at first below the value zero, since the fiber tuft $B_B$ is pulled back from the opener device 13 (see work phase C) and thus cannot be combed out as was described earlier through FIG. 3. The control device 4 connected to the drive 143 (e.g. single drive motor, powder magnet coupling between the feed roller 140 and a drive shaft etc. jointly associated with one of a plurality of adjoining feed rollers 140) controls the feed roller 140 in such a manner that the fiber tuft $B_B$ is released at the point in time $t_1$ and is once again moved towards the opener device 13. The fiber tuft $B_B$ reaches the opener device 13 at point in time $t_2$. The opener device 13 now resumes combing individual fibers $F_E$ out of the fiber tuft $B_B$. Fiber feeding accelerates and reaches its pre-feed speed $V_{SV}$ at point in time $t_3$. The individual fibers $F_E$ collect in the meantime in the fiber collection groove of the spinning rotor 12 and build up into a fiber ring there. The fiber feeding speed is now kept constant until it is reduced to its piecing speed $V_{Sa}$ at point in time $t_4$ along line $V_{Sb}$ or as a result of an exponential function (computation formulas $F_B$), reaching this piecing speed $V_{Sa}$ at point in time $t_7$.

The yarn $G_A$ to be pieced is in the meantime moved with its end into a readiness position inside the yarn draw-off channel 15 in a known manner which, among other things, depends on the settings $E_{221}$, $E_{222}$ and $E_{20}$ calculated by means of appropriate computation formulas $F_B$, whereby it constitutes a piecing reserve determined by settings $E_{210}$ and is held back by the yarn reserve hoop 21 (FIG. 1). In timely coordination with the above-mentioned reduction of fiber feeding speed along line $V_{Sb}$, the yarn $G_A$ to be spun is thrown off at point in time $t_5$ through dissolution of the yarn reserve held back by the yarn reserve hoop 21 (setting $E_{211}$). Already during the lowering of the fiber feeding speed along line $V_{Sb}$ by means of suitable control of the speed of feeding device 14, yarn draw-off begins at point in time $t_6$, at first still with a minimal acceleration (see draw-off phase $V_{F1}$). At point in time $t_8$, the fiber ring built up in the fiber collection groove before the start of yarn draw-off leaves the spinning rotor 12. Thereby the first, especially delicate draw-off phase $V_{F1}$ is completed. Fiber draw-off can now run up to its piecing speed $V_{Fa}$ in a second draw-off phase $V_{F2}$.

The yarn draw-off speed $V_F$ during the draw-off phases $V_{F1}$ and $V_{F2}$ depends on the twist produced by the rotation of the spinning rotor 12 and the manner in which the twist is distributed in different ways in the yarn $G_A$ as a function of fiber material and fiber draw-off speed. Therefore, the calculation of optimal twist required in the yarn $G_A$ for the incorporation of the fiber ring formed before the start of yarn draw-off and thereafter is important for a successful and satisfactory piecing. For that reason, the fiber draw-off speed $V_F$ is controlled in accordance with the calculated target rotational speeds in the yarn $G_A$ (see draw-off phases $V_{F1}$ and $V_{F2}$ in FIG. 2).

At point in time $t_9$, the piecing speed $V_{Sa}$ of fiber feeding and the piecing speed $V_{Fa}$ of yarn draw-off are at a defined speed ratio relative to the rotor speed, so that these speeds can be run up in a known manner to the applicable production speeds (not shown) while maintaining this speed ratio. It goes without saying that the bobbin $S_P$ is also driven at a corresponding speed in the direction of arrow $f_1$ or $f_2$ in coordination with the yarn movement.

Upon completion of the spinning process, the yarn $G_A$, which until then was handled by elements of the maintenance apparatus 2, is transferred to the corresponding elements and aggregates of the work station 10 (e.g. draw-off rollers 16, traversing guide 31) of the open-end spinning machine 1.

It has been shown that the resulting quality of the spun yarn $G_A$, with regard to its aspect as well as to its strength, can be optimized by changing the speed phase of fiber feeding represented by means of the broken line $V_{Sb}$ in FIG. 2. This modified speed phase is indicated in FIG. 2 by a continuous line. At a point in time $t_{4a}$ which is later than the point in time $t_4$ of the example of an embodiment described before, the feed roller 140 is strongly decelerated (see line $V_{Sb1}$), preferably with the strongest braking until its speed drops to a speed level $S_1$ at which the feeding speed is maintained constant or relatively constant within a relatively narrowly delimited speed range. The feed roller 140 is then again strongly decelerated (line $V_{Sb2}$) until another speed step $S_2$ is reached at which the feeding speed is again maintained constant or at least within a narrowly delimited speed range. The speed is again much reduced (line $V_{Sb3}$) after a predetermined time until finally the level of its piecing speed $V_{Sa}$ is reached.

The crossing of the line $V_{Sb}$ with the lines $V_{Sb1}$, $V_{Sb2}$ and $V_{Sb3}$ as well as with the lines representing the speed steps $S_1$ and $S_2$ results in triangles $\Delta_1$, $\Delta_2$, $\Delta_3$, $\Delta_4$ and $\Delta_5$ enclosed by these lines. By comparison with a fiber feeding represented by the line $V_{Sb}$, the triangles $\Delta_1$, $\Delta_2$, and $\Delta_3$ on the right side of line $V_{Sb}$ characterize a fiber surplus, while the triangles $\Delta_4$ and $\Delta_5$ on the left side of the line $V_{Sb}$ represent a fiber shortfall. By means of a suitable determination of the braking processes (lines $V_{Sb1}$, $V_{Sb2}$, $V_{Sb3}$) as well as of the speed steps $S_1$ and $S_2$ it is possible to cause the triangle $\Delta_4$ which characterizes a fiber shortfall, to compensate for a possible thick spot in the overlapping area of the back-fed yarn $G_A$ with the fiber ring that was formed already before the start of yarn draw-off. The triangle$\Delta_5$ can ensure that a thick spot formed by the residual of the fiber ring formed before the start of draw-off is attenuated. In similar manner, the triangle $\Delta_1$ indicating a fiber surplus can compensate for a thin spot following the previously mentioned overlapping area, while the triangle $\Delta_2$ can compensate for a thin spot following the point at which such a fiber ring is integrated. The magnitude of such a compensation for thick or thin spots in the yarn $G_A$ can be controlled through the placement and design of these braking phases and of the speed steps $S_1$ and $S_2$.

According to FIG. 2, the speed difference between the full pre-feed speed $V_{Sv}$ and the speed step $S_1$ is greater than the speed difference between the speed steps $S_1$ and $S_2$. Furthermore, the latter speed difference is greater than the speed difference between the speed step $S_2$ and the piecing speed $V_{Sa}$. Because of such a decrease in speed differences from the greater pre-feed speed $V_{Sv}$ in direction of the piecing speed $V_{Sa}$, the speeds $V_S$ of fiber feeding are caused to assume magnitudes making it possible to easily and effectively control the thick and/or thin spots in the yarn $G_A$ to be drawn off.

In addition to preparing the fiber tuft $B_B$, the preparation of the yarn end to be fed back into the spinning rotor 12 can also be prepared with respect to type and duration by means of a computation formula $F_B$ as a function of various factors. The point in time for yarn back-feeding as well as the back-feeding path of the yarn $G_A$ to be fed back and also the duration of its presence in the spinning rotor 12 until resumption of yarn draw-off are determined as a function of the preprogrammed values $W_n$ and of the numerical values $Z_n$ resulting from the data $D_n$ entered by means of the right computation formulas $F_B$ as function f of the values $W_n$ and of the numerical values $Z_n$, where $E_n$=f (Wn, $Z_n$).

The fiber tuft $B_B$ can also be pulled back from the area of influence of the opener device 13 in a manner different from reversing the direction in which the feed roller 140 is driven. The feed roller 140 and the feed trough 141 interacting with it can for instance be supported on a common support that can be swiveled away from the opener device 13 over a distance pre-calculated according to a suitable computation formula $F_B$ or can later be swiveled back into its work position to feed the fiber sliver $B_F$ to the opener device 13.

According to a simplified process variant, the magnitudes of the different settings $E_n$ are merely calculated so that the operator is able to select these settings $E_n$ according to these indications. Preferably, however, the calculated settings $E_n$ are also set immediately by the appertaining control device 4 or 5 and thus become effective in the calculated manner. This applies to the settings $E_n$ to be set for the actual piecing process as well as for those settings $E_n$, which serve to prepare such a piecing process.

The drawing of the input elements 450 and 460 of FIG. 1 in the form of turning knobs should merely be seen as an example of embodiments. Instead of these, it is also possible to provide an input keyboard or similar device. In order to prevent unauthorized modification of the preprogrammed values $W_n$, it is possible to write-protect these values $W_n$ so that they can be changed only if a code is entered.

The data $D_n$ to be provided by the operator for mechanical elements such as, e.g., the spinning rotor 12 can be in the form of numerical magnitudes entered such as rotor diameter, maximum permissible rotational speed, etc. In an alternative input method, all the model designations of all the spinning rotors that may be used are stored in the memory 43 of the control device 4 that are necessary for the incorporation into the various computation formulas $F_B$, e.g. rotor diameter, maximum rotor speed for this spinning rotor 12, and also the form as well as surface characteristics of the inner surfaces of the spinning rotor 12. In a similar manner, this also applies to other machine elements having an effect on the piecing process, e.g., on the draw-off nozzle 151 or on a replaceable false-twist element that can be inserted into the yarn draw-off channel 15. The replaceable false twist element influences the production of false twist as well as the propagation of twist into the spinning rotor 12 significantly with respect to form and surface characteristics. Here too, the numerical values $Z_n$ relevant for spinning are assigned to the corresponding model designation of the draw-off nozzle, etc., contained in the memory 43 and can be called up later to be used in the corresponding computation formula $F_B$.

It will be appreciated by those skilled in the art that various modifications and variations can be made in the present invention without departing from the scope of the invention. It is intended that the present invention include such modifications and variations as come within the scope of the appended claims and their equivalents.

The invention claimed is:

1. A process for piecing a yarn in an open-end spinning machine, the process comprising of the steps of:

providing optimized fiber material specific preprogrammed values in a control device with the preprogrammed values being relevant to optimized piecing of yarn in an open-end spinning device;

entering data relating to current prevailing spinning conditions which include fiber material information, yarn information and spinning element information of the open-end spinning device into the control device;

converting the data relating to current prevailing spinning conditions into numerical values;

computing settings of work phases relevant to piecing of yarn by using the preprogrammed values and the numerical values for current prevailing spinning conditions in multiple computation formulas;

using the settings calculated from the multiple computation formulas in the control of the piecing of the yarn in the open-end spinning device; and wherein different preprogrammed values are assigned to different fiber materials being spun, and based on the data relating to fiber material specified preprogrammed values assigned to the specified fiber material are incorporated into the multiple computation formulas.

2. A process as in claim 1, wherein the settings for work phases during at least one of a stopping of the open-end spinning device or a stoppage of the open-end spinning device are computed using the preprogrammed values and the numerical values.

3. A process as in claim 2, wherein the preprogrammed values and the data that is converted into the numerical values are entered to compute a point in time and a distance of retraction of a fiber tuft at a forward end of a fiber sliver from an action range of a fiber silver opener device during the stopping of the open-end spinning device.

4. A process as in claim 3, wherein the preprogrammed values and the data that is converted into the numerical values are entered to compute the point in time and releasing speed for a resumed feeding of the retracted fiber tuft to the fiber sliver opener device.

5. A process as in claim 1, wherein the computed settings are used to control operations of aggregates participating in the work phases during the piecing of the yarn.

6. A process as in claim 1, wherein the preprogrammed values are write-protected so that a code must be entered in order to change at least one of the preprogrammed values.

7. A process as in claim 1, further comprising storing the preprogrammed values and the numerical values in a memory and retrieving the preprogrammed values and the numerical values by entering a model designation to be incorporated into computation formulas of the multiple computation formulas that correspond to the model designation.

8. A process as in claim 7, wherein said spinning element comprises a spinning rotor and the preprogrammed values and the data that is converted into the numerical values relating to the spinning element information are stored in the memory and are associated with the model designation of the spinning rotor.

9. A process as in claim 8, wherein the preprogrammed values and the data that is converted into the numerical values relating to the spinning element information pertain to the diameter, maximum rotational speed, and type of surface characteristics of the spinning rotor.

10. A process as in claim 1, further comprising of the steps of bringing a feeding device for feeding fiber sliver to the open-end spinning device to a high pre-feeding speed and reducing the pre-feeding speed to a feeding device piecing speed in steps in coordination with a release of the yarn to be back fed into the spinning element based on the settings computed by appropriate computation formulas of the multiple computation formulas.

11. A process as in claim 10, wherein the feeding device has a predetermined speed ratio relative to the spinning element that is being driven at a spinning element piecing speed, whereby the feeding device is driven at at least one of a constant speed or a narrowly defined speed range for a pre-calculated period of time after each of the steps at which the speed is reduced.

12. A process as in claim 11, wherein the feeding device goes through at least two of the steps at which the speed is reduced.

13. A process as in claim 12, wherein timing and magnitudes of the steps at which the speed of the feeding device is reduced are such that thick spots and thin spots within the pieced yarn and within a zone of incorporation of residue of a fiber ring are minimized.

14. A process as in claim 11, wherein differentials between the speeds of the feeding device and the steps at which the speeds are reduced decrease from the higher pre-feeding speed in a direction of the feeding device piecing speed.

15. A process as in claim 1, wherein the preprogrammed values and the data that is converted into the numerical values are used in at least one appropriate computation formula of the multiple computation formulas for determining at least one of a type of preparation, a back feeding path of a yarn end of the yarn to be fed back into the spinning element or a point in time of starting fiber back-feeding into the spinning element.

16. A process as in claim 1, wherein the preprogrammed values and the data that is converted into the numerical values are used in at least one appropriate computation formula of the multiple computation formulas for determining an optimal twist in length segments of the yarn corresponding to different draw-off phases at a fiber ring formed in the spinning rotor and an optimal twist in the yarn being drawn off.

17. A process as in claim 16, wherein the preprogrammed values and the data that is converted into the numerical values are used in at least one appropriate computation formula of the multiple computation formulas for determining draw-off speed of the length segments of the yarn to obtain the optimal twist.

18. A process as in claim 1, wherein the preprogrammed values and the data that is converted into the numerical values are used in at least one appropriate computation formula of the multiple computation formulas for determining type, frequency, and times of at least one of a one-time cleaning or multiple cleanings of the spinning element during at least one of a stoppage of the spinning element or a running up to a reduced piecing speed.

19. A device for piecing a yarn in an open-end spinning machine having a plurality of work stations, each of the work stations including a spinning element, said device comprising:

a plurality of aggregates used in the piecing of the yarn, said plurality of aggregates including a feeding device to feed a fiber sliver to an opener device;

an individual control device at each said respective work station in communication with said plurality of aggregates, said control device at least partially controlling said plurality of aggregates participating in the piecing of the yarn;

a memory carried within said control device, said memory storing computation formulas used to calculate settings for work phases employed by said control device during the work phases to control said plurality of aggregates participating in the piecing of the yarn as a function of current spinning conditions, and said memory storing preprogrammed optimized values to be incorporated into said computation formulas; and an input device carried within said control device, said input device being in communication with said memory and configured to input data relating to current prevailing spinning conditions which include fiber material information, yarn information and spinning element information of the open-end spinning device into the control device with said data being converted into numerical values for use in said computation formulas.

20. A device as in claim 19, wherein said control device employs said computation formulas to develop settings for work phases during at least one of a stopping of the open-end spinning device or a stoppage of the open-end spinning device to control aggregates of said plurality of aggregates that have an effect on piecing of the yarn.

21. A device as in claim 20, wherein said control device is in communication with drives of said aggregates to allow the driving of said aggregates in accordance with said settings computed from said computation formulas.

22. A device as in claim 21, wherein said control device directs said feeding device in a manner that said feeding device retracts a fiber tuft of an end of the fiber sliver from an action range of said opener device.

23. A device as in claim 21, wherein said control device brings said feeding device into a pre-feeding speed and then reduces said speed of said feeding device to at least one speed step between said pre-feeding speed and a piecing speed of the feeding device before lowering said speed to said feeding device piecing speed in a pre-calculated manner so that said feeding device is at a predetermined speed ratio relative to a reduced speed of the spinning element.

24. A device as in claim 23, wherein said speed of said feeding device at said at least one speed step is maintained so as to be at least one of a constant speed or a narrowly defined speed range for a pre-calculated period of time.

* * * * *